US005094383A

United States Patent [19]

Anderson et al.

[11] Patent Number: 5,094,383

[45] Date of Patent: Mar. 10, 1992

[54] GOLF CLUB HEAD AND METHOD OF FORMING SAME

[76] Inventors: Donald A. Anderson, 7861 Clay Ave. #4, Huntington Beach, Calif. 92648; Donald J. C. Sun, 4521 Ocean Valley La., San Diego, Calif. 92130

[21] Appl. No.: 549,973

[22] Filed: Jul. 9, 1990

Related U.S. Application Data

[63] Continuation-in-part of Ser. No. 492,973, Mar. 13, 1990, Pat. No. 5,024,437, which is a continuation-in-part of Ser. No. 364,698, Jun. 12, 1989, abandoned.

[51] Int. Cl.[5] ..... A63B 53/00; B23K 31/00

[52] U.S. Cl. ..... 228/176; 228/125; 228/162; 164/76.1

[58] Field of Search ..... 228/125, 162, 176, 182; 164/76.1; 273/167 R, 167 J, 173, 78

[56] References Cited

U.S. PATENT DOCUMENTS

| | | | |
|---|---|---|---|
| 3,218,072 | 11/1965 | Burr . | |
| 3,970,236 | 7/1976 | Rogers | 273/173 |
| 4,027,885 | 6/1977 | Rogers | 273/173 |
| 4,252,262 | 2/1981 | Igarashi | 273/167 J |
| 4,465,221 | 8/1984 | Schmidt | 273/173 |
| 4,534,558 | 8/1985 | Yoneyama . | |
| 4,792,140 | 12/1988 | Yamaguchi et al. . | |

FOREIGN PATENT DOCUMENTS

| | | | |
|---|---|---|---|
| 211781 | 12/1957 | Australia | 273/173 |
| 243435 | 11/1925 | United Kingdom | 273/173 |
| 1227948 | 4/1971 | United Kingdom . | |
| 2146249 | 4/1985 | United Kingdom | 273/173 |

*Primary Examiner*—Samuel M. Heinrich
*Attorney, Agent, or Firm*—William W. Haefliger

[57] ABSTRACT

A golf club head has a main body portion formed by an investment casting of material such as stainless steel, beryllium copper, titanium, and aluminum. The face plate of the head is formed of a forged metal, such as forged carbon steel, this plate being welded to the face portion of the casting to form an integral assembly therewith. The forged metal faceplate affords a more solid impact and feel to the club which provides better control. Also, it has very high strength. Preferably, the head consists of cast stainless steel, and the face plate of forged stainless steel, both steels being of the same composition.

8 Claims, 3 Drawing Sheets

FIG. 8.
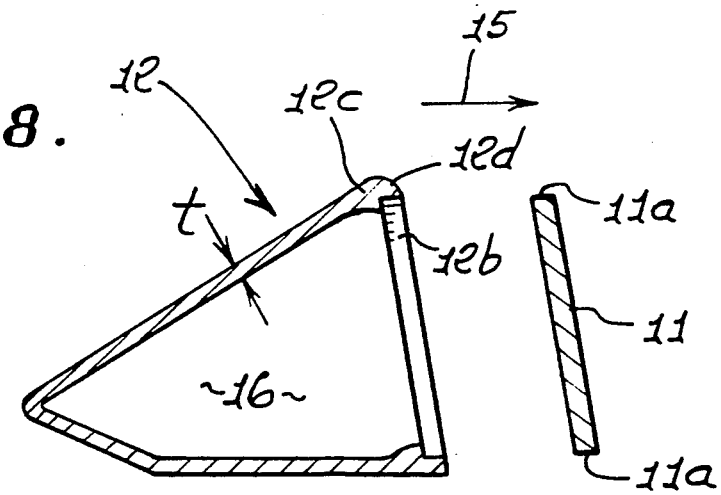
FIG. 9.
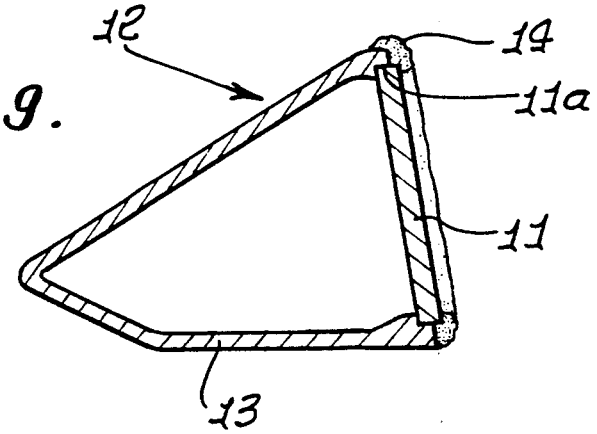
FIG. 10.
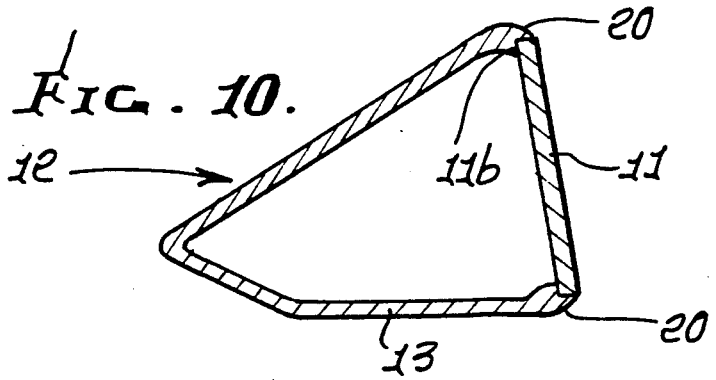
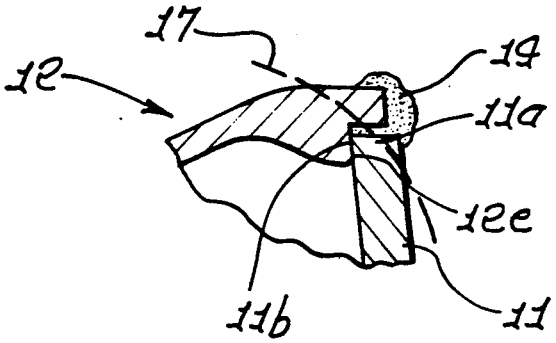
FIG. 11.

GOLF CLUB HEAD AND METHOD OF FORMING SAME

BACKGROUND OF THE INVENTION

This application is a continuation-in-part of application Ser. No. 492,973 filed Mar. 13 1990, now U.S. Pat. No. 5,024,437, which is a continuation-in-part of Ser. No. 364,698 filed Jun. 12, 1989, now abandoned.

This invention relates to golf clubs and more particularly to an improved face plate construction for a golf club head.

The heads of golf clubs ar generally formed in a one-piece casting of durable materials, such as stainless steel, beryllium copper, aluminum, etc. A head of this type is described in U.S. Pat. No. 4,021,047 issued May 3, 1977, to R. J. Mader. The use of face plates made of a different material than that of the main body of the club head has been used in the prior art in both irons and "wood"-type drivers, which are often made of cast metal. Such prior art club heads are described in U.S. Pat. No. 4,792,140 issued Dec. 20, 1988, to Yamaguchi et al.; U.S. Pat. No. 4,534,558 issued Aug. 13, 1985, to Yoneyama; U.S. Pat. No. 3,218,072 issued Nov. 16, 1965, to Burr; and British Patent No. 1.227.948 issued Apr. 15, 1971, to Haines et al. In the heads of all of these prior art patents, the face plate is of a plastic material, such as a resin or a carbon fiber composite. It has been found that the use of a forged metal for the face plate of the club head results in a more solid impact and feel which provides better control. However, forged metal is not amenable to casting which mitigates against its use for forming the entire head. Also, forged metal tends to have a high density which would make for a club head having excessive weight.

SUMMARY OF THE INVENTION

The golf club head of the present invention provides an improvement over prior art heads in that it utilizes a face plate of forged metal. This end result is achieved without greatly increasing the cost or weight of the driving head by forming the main body of the head in an investment casting of a material such as stainless steel, beryllium copper, titanium, or aluminum, and then attaching a face plate of a forged metal selected from the class consisting of forged carbon steel, forged stainless steel, forged beryllium copper, and forged titanium by suitable means such as welding.

It has been found that forged metal face plates have an inherently greater strength than cast metal face plates with a more uniform hardness over the hitting area of the plate. This is in view of the low porosity, high density and homogeneous grain structure of such a material which makes for a more solid plate. On the other hand, cast metal is desirable for the main body of the club head in view of its lighter weight which tends to keep down the overall weight of the club head. It is essential that the face plate be solidly attached to the main body of the head by means such as welding to make for a solidly integrated head structure.

It is therefore an object of this invention to provide a golf club head having a face plate of a forged metal which gives more solid impact resistance and feel, to provide better control.

These and other objects and advantages of the invention, as well as the details of an illustrative embodiment, will be more fully understood from the following specification and drawings, in which:

DRAWING DESCRIPTION

FIGS. 8–10 are sections taken in elevation to show plate and head attachment; and FIG. 11 is an enlarged section showing welding and finishing.

DETAILED DESCRIPTION

Referring to FIGS. 1–4, a first embodiment of the invention is illustrated. Face plate 11, which is fabricated of a material selected from the class consisting of forged carbon steel, forged stainless steel, forged beryllium copper, and forged titanium, has a lip portion 11*a* formed thereon. The main body 12 of the club head is formed by the investment casting of a material, such as stainless steel, beryllium copper, titanium, aluminum, etc. Main body portion 12 has a slot 12*a* formed therein and a recessed portion 12*b* which matingly receives face plate 11 with lip portion 11*a* fitting into slot 12*a*. Face plate 11 is solidly integrated with main body portion 12 by weld joints 14 formed along the perimeter of the face plate. In this manner, the face plate is solidly integrated with the casting.

Figure 1:
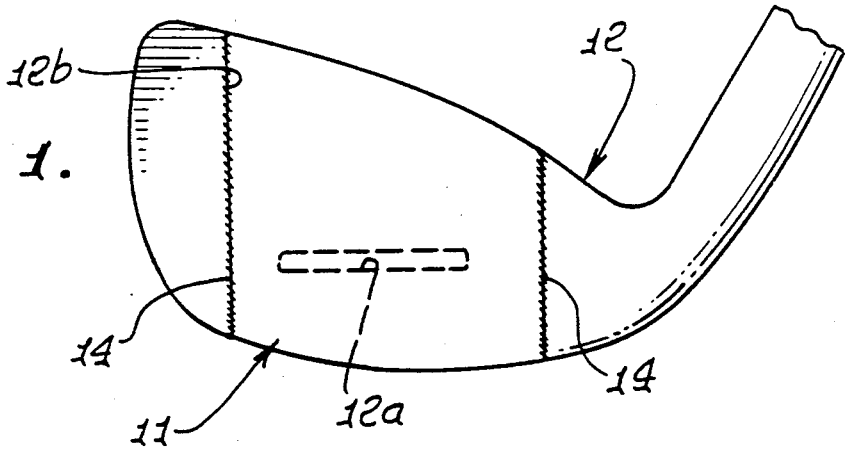
FIG. 1 is a side elevational view of a first embodiment of the invention.
Figure 2:
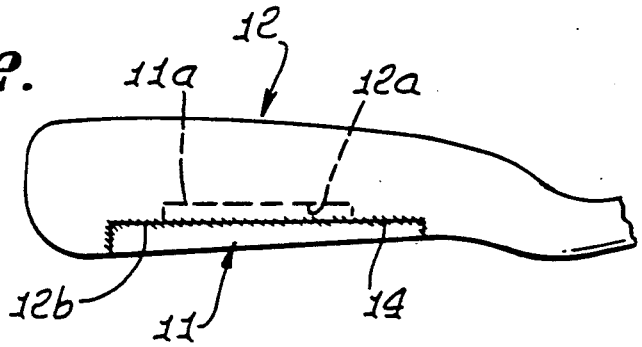
FIG. 2 is a bottom plan view of the first embodiment.
Figure 3:
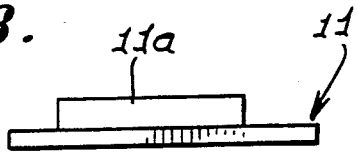
FIG. 3 is a top plan view illustrating the face plate employed in the first embodiment.
Figure 4:
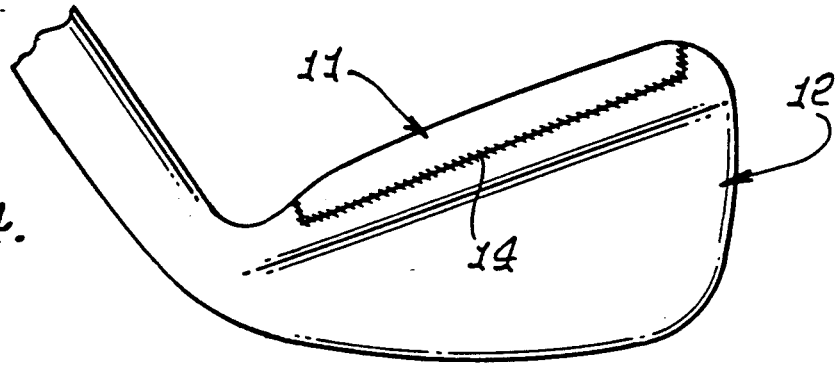
FIG. 4 is a top plan view of the first embodiment.
Figure 5:
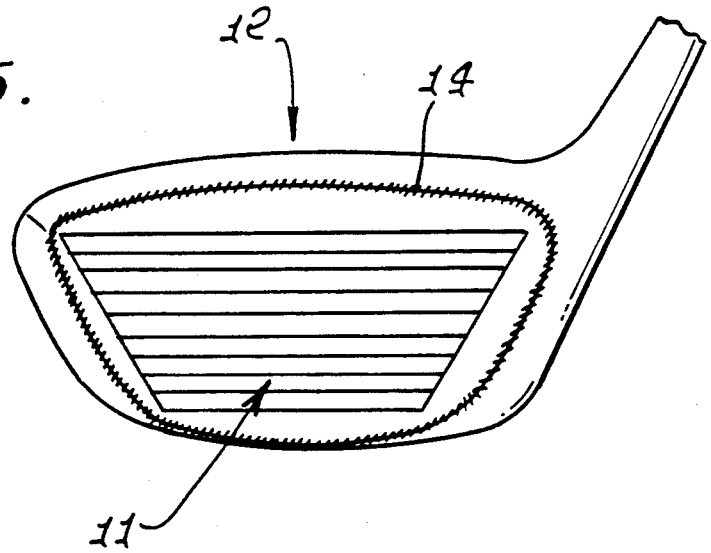
FIG. 5 is a side elevational view of a second embodiment of the invention.
Figure 6:
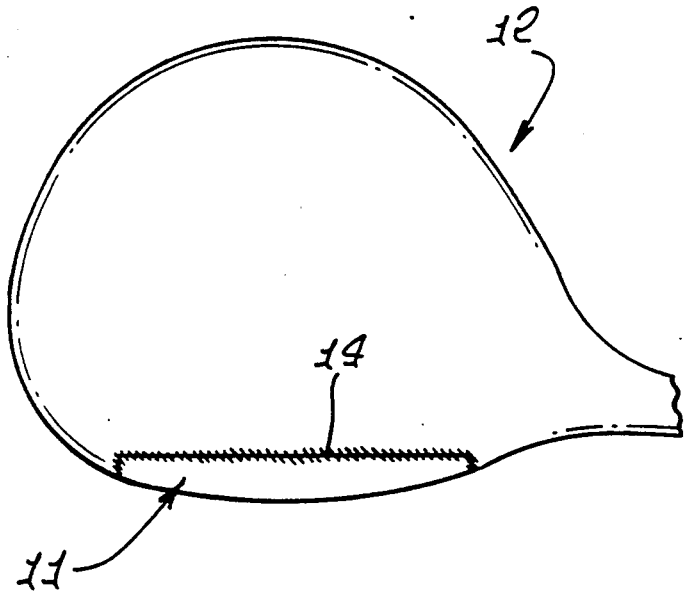
FIG. 6 is a bottom plan view of the second embodiment.
Figure 7:
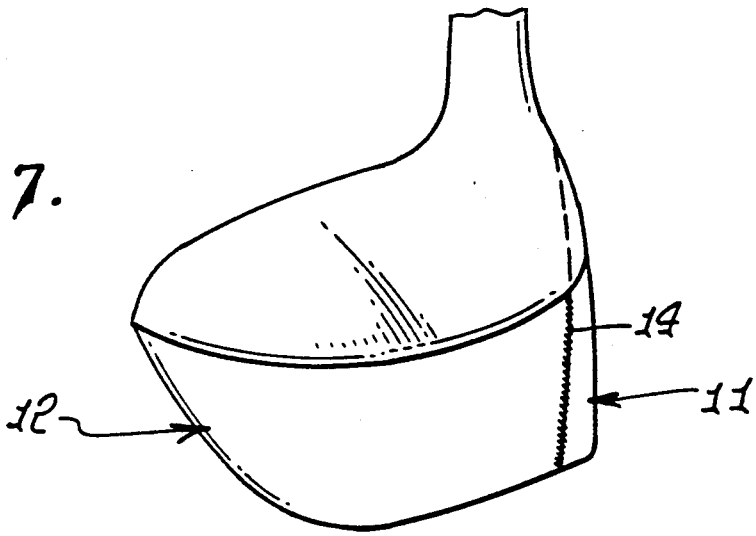
FIG. 7 is a front perspective view of the second embodiment.

Referring now to FIGS. 5–7, a second embodiment of the invention is illustrated, this embodiment being a "wood"-type driver. The main body portion 12, as for the previous embodiment, is formed by investment casting from a material such as stainless steel, beryllium copper, titanium, aluminum, etc. The face plate 11, as for the previous embodiment, is fabricated of forged metal selected from the same class of materials as for the first embodiment. The face plate 11 is abutted against the front surface of the casting and solidly joined thereto along weld joints 14, which run along the perimeter of the face plate thereby integrating the face plate with the casting.

For best results, both the head and the face plate consist of the same high strength material, i.e., stainless steel. One such steel is 17–4 PH forged stainless steel. This facilitates best weld connection of these parts and resistance to separation upon repeated sharp impacts with golf balls. See in this regard FIGS. 8–11, showing connection of these parts.

In FIG. 8, the peripheral slot 12*b* is shown formed in a thickened portion 12*c* of the cast stainless steel head which projects forwardly. See arrow 15. The slot and thickened portion 12*c* extend in a loop about the open end of the head, which is hollow at 16. Thickness "t" of the main wall extent of the head, rearward of 12*c*, is typically within the range 0.50 and 0.070 inches, except that the sole plate is typically between 0.085 and 0.100 inches. Head looping lip 12*d* overhangs the slot 12*b*, which is generally L-shaped in cross section. See FIG. 11.

FIG. 9 shows the forged stainless steel plate 11 looping periphery 11*a* closely fitted into the looping slot 12*b*; and FIG. 11 also shows this as well as the plate wall 11*b* abutting the looping ledge 12*e* which constitutes one wall of the slot.

FIG. 11 also shows weld material 14 applied to the elements 12*d* and 11*a*, and penetrating the clearance between 11*a* and 12*d*. After grinding, as along finish line 17, the looping peripheral edge of the head and plate is forwardly convexly rounded, as at 20 in FIG. 10, some weld material remaining, as in the clearance. A high strength, rigid connection is thereby effected between the high strength, compatible stainless steel elements 11 and 12, with element 11 being forged for extremely high strength and resistance to failure as by crack formation, and resistance to deformation, in use.

Forged plate 11 is preferably of uniform thickness, within the range 0.090 and 0.130 inches, and is thicker than sole plate 13.

The method of forming the high strength head includes the steps:

a) casting a golf club head main body consisting of metal, b) forging a golf club head face plate consisting of metal, c) weld connecting the forged face plate to the front of the head main body to conform to the front periphery of the body.

Further, the a) step typically includes forming a lip 12*d* at the periphery of the head main body, and the c) step includes weld connecting the periphery 11*a* of the forged face plate to the lip 12*d*; and including grinding the weld, the lip and the plate periphery to form a forwardly convex and smooth head surface bounding the periphery of the plate.

While the invention has been described and illustrated in detail, it is to be clearly understood this is intended by way of illustration and example only and is not to be taken by way of limitation, the spirit and scope of the invention being limited only by the terms of the following claims.

We claim:

1. The method of forming a high strength, metallic, golf club head, which includes:

a) casting a golf club head main body consisting of metal, b) forging a golf club head face plate consisting of metal, c) weld connecting the forged face plate to the front of the head main body to conform to the front periphery of the body, d) said weld connecting carried out to form four elongated peripheral weld portions having generally trapezoidal configuration, with an upper elongated weld portion being generally upwardly convex, and a lower elongated weld portion being generally downwardly convex.

2. The method of claim 1 wherein said a) step includes forming a lip at the periphery of the head main body, and said c) step includes weld connecting the periphery of the forged face plate to said lip; and including grinding said weld, said lip and said plate periphery to form a forwardly convex and smooth head surface bounding the periphery of the plate.

3. The method of claim 1 wherein said head main body and said face plate both consist of stainless steel.

4. The method of claim 2 including forming a clearance between the lip and periphery of the plate, and causing weld material to enter the clearance prior to said grinding step.

5. The method of claim 4 wherein said grinding is carried out to intersect said clearance.

6. The method of claim 4 wherein said a) step includes casting said main body to form a heel and a toe of said head, and to form a recessed portion into which the periphery of the face plate is to be fitted, then fitting said face plate periphery into said recessed portion, said step c) including locating one of said peripheral weld portion closer to the heel than to the toe of the head, and locating another of the peripheral weld portions closer to the toe than to the heel.

7. The method of claim 1 which includes locating said upper peripheral weld portion closer to the top than to the bottom of the head, and locating said lower peripheral weld portion closer to the bottom than to the top of the head.

8. The method of claim 6 including orienting said weld elongated peripheral portions to substantially define a trapezoid.

* * * * *